United States Patent [19]

Lipman

[11] 4,425,831

[45] Jan. 17, 1984

[54] ELECTRIC GUITAR TRANSDUCER MOUNTING

[76] Inventor: Barry Lipman, 1186 Post Rd., Scarsdale, N.Y. 10583

[21] Appl. No.: 356,946

[22] Filed: Mar. 11, 1982

[51] Int. Cl.[3] ..... G10H 3/00

[52] U.S. Cl. ..... 84/1.16; 84/1.15

[58] Field of Search ..... 84/1.14, 1.15, 1.16, 84/267

[56] References Cited

U.S. PATENT DOCUMENTS 4,142,435 3/1979 Pozar ..... 84/1.15

4,254,683 3/1981 Nulman ..... 84/1.15

*Primary Examiner*—F. W. Isen

*Attorney, Agent, or Firm*—Robert W. Fiddler

[57] ABSTRACT

An electric guitar transducer mounting permitting rapid interchange and replacement of transducers in an electric guitar. An electric guitar of any desired contour is formed with an opening extending from the front face through to the back of the guitar body, with this body opening dimensioned to accommodate any one of the generally available transducers (pickups) employed with electric guitars. A sleeve is formed dimensioned to fit within the guitar body opening, and provided with an entry opening from the back of the guitar body to receive a module containing a transducer. The sleeve is formed with electrical terminals engageable with the module and electrically coupled to the wiring in the conventional electric guitar body. The module is formed with a selectively removable top plate engaging and securing a given transducer in the module for selective positioning in the sleeve.

12 Claims, 5 Drawing Figures

ELECTRIC GUITAR TRANSDUCER MOUNTING

BACKGROUND OF THE INVENTION

This invention relates to the art of electric guitar transducer mountings, and more particularly, to an improved mounting for a transducer permitting ready removal and interchange of transducers in an electric guitar, without requiring removal of the guitar strings, and desoldering and resoldering of connecting wires, permitting the user to compare different transducers and/or to change transducers rapidly where this is deemed desirable.

Transducers have conventionally been mounted in electric guitars so as to convert the vibration in the guitar string into an electrical signal which may thereafter be amplified or otherwise modulated as desired.

Such transducers are conventionally mounted in the guitar body by positioning the transducer in an opening arranged beneath the strings on the front of the guitar body. Exchange or replacement of the transducer requires loosening of the strings to permit them to be moved away from the opening in the front of the guitar body, so as to provide access to the transducer. Thereafter, removal of the transducer generally requires desoldering of the connecting wires, and replacement requires resoldering of wires, resecurement of the transducer, and retuning of the guitar.

Since different transducers may produce different effects, many musicians will employ different transducers in the same guitar body, and when purchasing a transducer, will try out a number of different transducers to determine which produces what is for them the most desired effect.

This replacement and interchange of transducers is obviously cumbersome and time consuming.

BRIEF DESCRIPTION OF THE INVENTION

It is with the above problems and considerations in mind that the present improved electric guitar transducer mounting has been evolved, permitting rapid replacement and interchange of transducers in an electric guitar.

It is accordingly among the primary objects of the invention to provide an improved transducer mounting for electric guitars, facilitating the positioning of the transducer in the guitar, without requiring string removal.

Another object of the invention is to provide an improved electric guitar transducer mounting permitting rapid replacement of the transducer, without requiring desoldering and soldering.

A further object of the invention is to provide an improved electric guitar transducer mounting permitting the user to rapidly interchange different transducers for purposes of comparing effects.

These and other objects of the invention, as will become hereafter apparent, are achieved by forming an electric guitar body with an opening extending from the front through to the rear of the guitar body, with the opening dimensioned to accommodate any one of the conventionally available transducers. A sleeve is provided, fitting in the guitar body opening, with the sidewalls of the sleeve preferably inwardly spaced from the opening sidewalls and provided with a flange extending from the sleeve sidewalls over the guitar front, limiting the movement of the sleeve into the guitar body opening which may be formed with an undercut dimensioned to accommodate the flange. The sleeve is provided with electrical terminals connected to the leads from the wiring in the guitar body, and positioned for electrical contact with the terminals of the transducer containing module received in said sleeve. This transducer receiving module is shaped to sit within the sleeve and is provided with mating terminals engaging the sleeve terminals and securing the module in the sleeve. The module is hollow and dimensioned to accommodate any available transducer. A top plate on the module engages and secures a transducer in operative position in the module.

A feature of the invention resides in the fact that transducers may be rapidly positioned and/or replaced in operative position in the guitar without having to displace and return the strings, or desolder and resolder wires.

Another feature of the invention resides in the accommodation of the transducer in the guitar body with minimum physical stress on the transducer due to dimensional changes in the guitar body.

A further feature of the invention resides in the plug interconnect between module and sleeve, permitting the module to be turned 180°.

BRIEF DESCRIPTION OF THE DRAWINGS

The specific details of a preferred embodiment of the invention, and of the manner and process of making and using same, will be described in full, clear, concise and exact terms, so as to enable any person skilled in the art to which it pertains to make and use same, in conjunction with the accompanying drawings, wherein.

DESCRIPTION OF PREFERRED EMBODIMENT OF THE INVENTION

Figure 1:
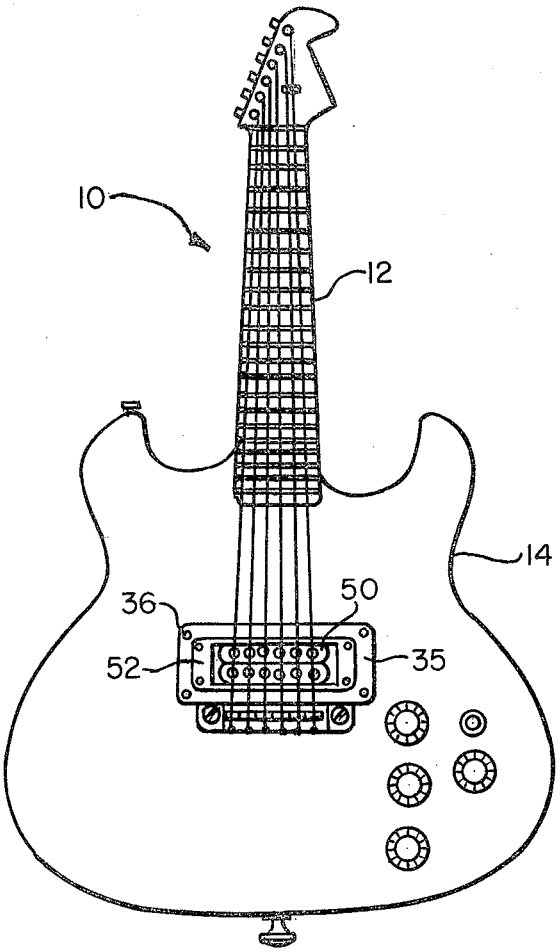
FIG. 1 is a top plan view showing the front of an electric guitar provided with a transducer mounting in accordance with the invention.
Figure 2:
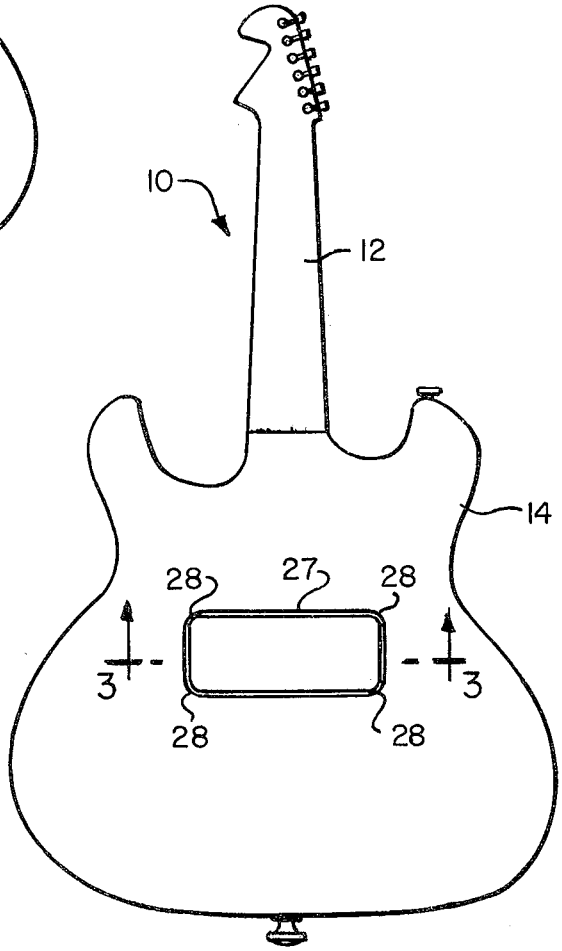
FIG. 2 is a plan view looking at the rear of the guitar shown in FIG. 1 showing the opening in the back of the guitar body receiving the transducer module.

As best seen in the drawings, an electric guitar 10 is shown in FIGS. 1 and 2 formed as conventionally with a fretted fingerboard 12, and body 14. The particular shape of the guitar body, neck, head and fingerboard can be of any desired configuration, as will be understood by those skilled in the art.

Figure 5:
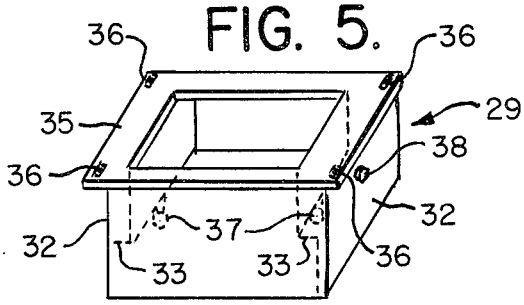
FIG. 5 is a perspective view of the mounting sleeve for the transducer module.
Figure 3:
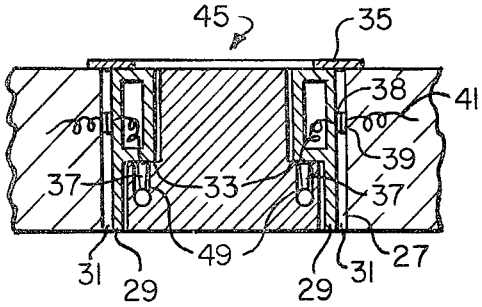
FIG. 3 is a cross-sectional view taken on line 3—3 of FIG. 2 showing the transducer module in its mounting sleeve in the guitar body.

In accordance with the invention, the guitar body 14 is formed with a rectangular opening 27 extending through from front to back of the guitar body opening, and is dimensioned to accommodate sleeve 29, as seen in FIG. 5. In the illustrated embodiment, opening 27, as best seen in FIGS. 2 and 3, is formed of a rectangular cross-section, as viewed both in the plane of the guitar body and in a direction transverse thereto. The corners 28 may be rounded, as seen in FIG. 2.

Sleeve 29 is similarly formed of a rectangular cross-section similar to that of the opening 27, as best seen in FIGS. 1 and 3. The transverse cross-section of the sleeve 29, as best seen in FIG. 3, is of an area slightly less than the area of the transverse cross-section of opening 27, to provide a clearance 31 between the sidewalls of the sleeve 29 and opening 27. Lateral sidewalls 32 of the illustrated embodiment are formed with seats 33 on the interior surface thereof as best seen in FIGS. 3 and 5. A flange 35 is extended peripherally from the top of the sidewalls of sleeve 29 a distance such that it will overlie the front face of guitar body 14, as best seen in FIGS. 1 and 3. Screw holes in the flange 35 receive screws 36, which serve to secure the sleeve 29 in position in the guitar body opening 27.

Male plugs 37 extend from seat 33 and are electrically coupled via contacts 38, and 39 to wiring in the guitar body, as best seen in FIG. 3.

Figure 4:
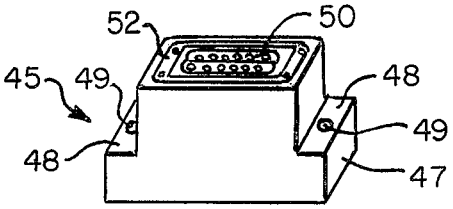
FIG. 4 is a perspective view of the transducer module.

Module 45, as best seen in FIG. 4, is provided in the illustrated configuration dimensioned to fit within sleeve 29 and formed with a base portion 47 providing shoulders 48 on opposed sides dimensioned to seat on seat 33 of sleeve 29. Electrical sockets 49 are provided of a size and at locations on shoulders 48 to mate with plugs 37, as best seen in FIG. 3. These sockets are electrically coupled to a transducer 50 held within the module. A top plate 52 on module 45 serves to secure the transducer within the module. This is done by forming the plate with screw holes accommodating a set of screws engaging the transducer 50, and a set of screws engaging the module.

OPERATION

In use, an electric guitar is formed with opening 27, either by molding the opening where the guitar body is molded, or by cutting, boring, drilling, or otherwise shaping the opening in an already formed guitar body.

Sleeve 29 is formed either by molding of a plastic material, or by shaping a sheet material, such as sheet metal, or sheet plastic, or by carving from wood into the above described and illustrated contours, dimensioned to fit with clearance in opening 27, and fitted into this opening 27. The clearance 31, as illustrated in FIG. 3 serves to accommodate any expansion or warping of the guitar body, without exerting pressure on the module 45 in the sleeve.

The module 45 is formed by molding or otherwise shaping of plastic, wood, or the like into the above described and illustrated contours. A metallic surface coating may be applied to the exterior module surface for shielding purposes. The interior of the module is hollowed out to accommodate the transducer which it is desired to employ. The module may either be formed with a hollow permitting different transducers to be selectively inserted therein, or different transducers may be contained within the module at the time of manufacture.

In use, a guitar 14 is provided with the sleeve 29, different transducers may be operatively positioned in the guitar body by merely slipping the module 45 containing the desired transducer into the sleeve 20. There is no need to loosen strings or otherwise manipulate them.

Plugs 37 engage in sockets 49 effecting desired electrical contact between the transducer and the guitar wiring, and mechanically retain the module in position. These symmetrically positioned plugs serve to permit the module to be rotated 180°.

The user can thereafter rapidly remove and replace the transducer to compare different transducers and/or to obtain the effects of different transducers.

The above disclosure has been given by way of illustration and elucidation, and not by way of limitation, and it is desired to protect all embodiments of the herein disclosed inventive concept within the scope of the appended claims.

What is claimed is:

1. An electric guitar having guitar strings and wiring for coupling of a transducer supported adjacent the guitar strings to an amplifier, said guitar comprising: a guitar body defining the outer contours of the guitar with the strings anchored to said body with an opening extending through from the front to the back of said body; a module containing the transducer dimensioned to fit into and removably mounted in said guitar body opening from the back of said body; and electrical connections in said body between said module and the guitar wiring, whereby the transducer may be selectively removed without disturbing the guitar strings.

2. An electric guitar as in claim 1, in which a sleeve is positioned in said guitar body opening to receive said module.

3. An electric guitar as in claim 2, in which said sleeve is dimensioned to fit within said guitar body opening with a clearance therebetween.

4. An electric guitar as in claim 2, in which said sleeve is formed with a seat on an inner wall against which said module rests.

5. An electric guitar as in claim 4, in which a plug and socket are formed between said sleeve and said module to effect an electrical connection.

6. An electric guitar as in claim 2, in which said sleeve is formed with a flange extending over the front of the guitar.

7. A guitar as in claim 1, in which a top plate is secured to said module and the transducer within said module.

8. A guitar as in claim 1, in which said module may be rotated 180° in the guitar opening.

9. A guitar as in claim 1, in which said module is formed of an electrically insulating material coated with an electrically conductive material forming an electrical shield.

10. A method of rapidly and simply replacing and/or exchanging the transducer of an electric guitar having guitar strings, a body defining the outer contours of the guitar with the strings anchored to said body and electrical wiring for coupling a transducer adjacent the guitar strings to an amplifier; said method comprising the steps of: forming an opening in the guitar body extending through from the front of the back of the body; enclosing the transducer to be used in a module fittable within said opening from the back of the guitar body; and providing electrical connections in the guitar body between the transducer in the module and the guitar wiring.

11. A method as in claim 10, in which a sleeve is inserted into the opening surrounding the module.

12. A method as in claim 11, in which the sleeve is positioned in the opening with a clearance therebetween.

* * * * *

UNITED STATES PATENT AND TRADEMARK OFFICE

CERTIFICATE OF CORRECTION

PATENT NO. : 4,425,831

DATED : January 17, 1984

INVENTOR(S) : Barry Lipman

It is certified that error appears in the above-identified patent and that said Letters Patent are hereby corrected as shown below:

In claim 10, column 4, line 53, should read - - - extending through from the front to the back of the - - -

Signed and Sealed this

*Seventeenth* Day of *April 1984*

[SEAL]

*Attest:*

GERALD J. MOSSINGHOFF

*Attesting Officer*

*Commissioner of Patents and Trademarks*